US005557849A

United States Patent [19]

Lee et al.

[11] Patent Number: 5,557,849

[45] Date of Patent: Sep. 24, 1996

[54] NAIL CLIPPER

[75] Inventors: Young S. Lee; Jong C. Kim, both of Seoul, Rep. of Korea

[73] Assignees: Y.S. Creation Co., Ltd., Rep. of Korea; Meepo USA Co., Calif.

[21] Appl. No.: 570,662

[22] Filed: Dec. 11, 1995

[51] Int. Cl.[6] ..... A45D 29/02

[52] U.S. Cl. ..... 30/29; 132/75.4

[58] Field of Search ..... 30/26, 27, 28, 30/29; 132/73, 73.5, 75.3, 75.4

[56] References Cited

U.S. PATENT DOCUMENTS

| | | | |
|---|---|---|---|
| 1,163,445 | 12/1915 | Randolph | 132/75.4 |
| 2,616,436 | 11/1952 | Langley | 30/29 |
| 2,955,354 | 10/1960 | Laing | 30/29 |
| 3,838,507 | 10/1974 | Clark | 30/29 |
| 4,856,190 | 8/1989 | Reoswig | 30/29 |
| 5,065,513 | 11/1991 | Reiswig | 30/29 |

*Primary Examiner*—Hwei-Siu Payer
*Attorney, Agent, or Firm*—Raymond Sun

[57] ABSTRACT

A nail clipper includes a clipper body having a front section and a rear section acting as a first handle, the front section including a top plate and a base plate defining a passageway therebetween. The top plate and the base plate each has an aperture substantially aligned to each other and adapted to receive a finger nail therewithin. A blade is slidably positioned in the passageway. The nail clipper further includes a second handle having a front end connected to the blade, and a flexible plate. The first end of the flexible plate is attached to the second handle and the opposing second end of the flexible plate is attached to the first handle. The flexible plate is adapted to normally bias the second handle and the blade in a retracted position rearward from the apertures. However, when the second handle is gripped against the first handle, the bias of the flexible plate is overcome to advance the blade from the retracted position to a forward position in which the cutting edge of the blade passes the apertures to cut a finger nail positioned within the apertures.

9 Claims, 2 Drawing Sheets

FIG. 4
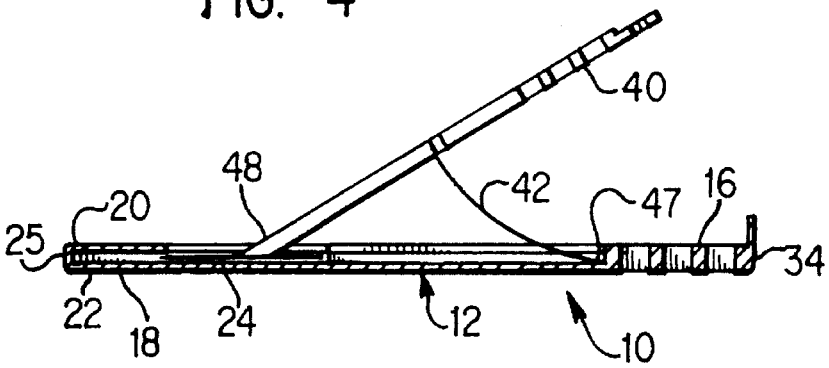
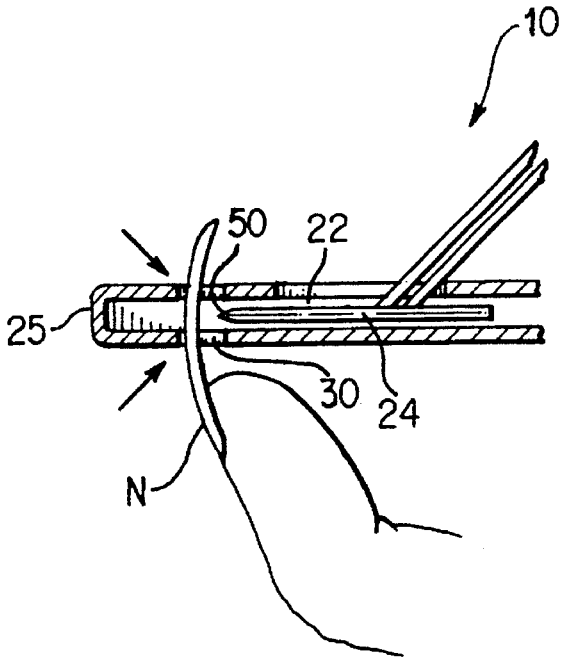
FIG. 5
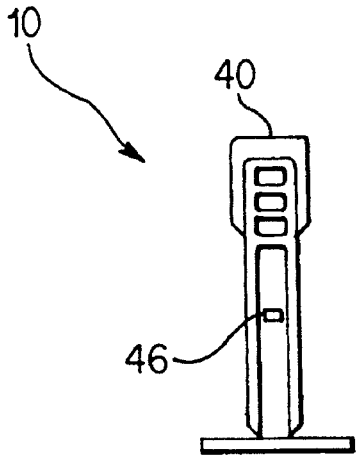
FIG. 6

NAIL CLIPPER

BACKGROUND OF THE INVENTION

1. Field of the Invention

The present invention relates to finger nail clippers, and in particular, to a simplified nail clipper that can be used to cut both natural and artificial nails.

2. Description of the Related Art

Long finger nails have been popular for some time. Women, and some men, deliberately allow specific nails to grow, or others simply attach artificial nails to their existing nails to provide the appearance of longer natural finger nails.

The process of attaching artificial nails can be rather troublesome. Artificial finger nails are typically composed of elongate plastic material such as acetate or styrene with a crescent-shaped cross-section similar to that of a natural nail but much thicker. Artificial nails are typically first attached to the natural nail and then clipped to length with a series of lateral cuts across the nail to form a rough outline of desired nail curvature. The roughened edge is filed to a smooth continuous curvature and then buffed to complete the process. In the filing step, harmful plastic dust is introduced into the surrounding environment. A full set of artificial nails can take up to two hours to apply using the above process.

Attempts have been made to simplify this process for applying a set of artificial nails. One such attempt is illustrated in U.S. Pat. No. 4,856,190 to Gary J. Reiswig, which discloses a clipper which purportedly clips an artificial nail to its final shape with a single cut and with selective curvature to minimize the filing needed after clipping. The clipper comprises a clipper body having a stationary handle and a head section which forms a rectangular passage through which a blade is slidably housed. A movable handle pivots on the clipper body about a first pin, while a second pin couples the movable handle to the rear end of an elongated flat link. The link comprises a notch having an upper tongue insertable into a slot on the blade. A spring couples the link to the stationary handle and biases the link downwardly in a counterclockwise direction shown in FIG. 1. The notch and its upper tongue are coupled to the slot of the blade. If the movable handle is pivotally closed against the stationary handle, the notch of the link will drive the blade toward a forward position shown in phantom in FIG. 3. Upon releasing the movable handle, the spring urges the movable handle away from the stationary handle causing the upper tongue of the link to pull or retract the blade from its forward position back to its original position. The nail holder is provided with a crescent shaped aperture adapted to retain an artificial nail. In use, the movable handle is closed to cause the blade to be driven to its forward position, passing over the aperture and severing the nail held in the aperture.

While the clipper described in U.S. Pat. No. 4,856,190 is helpful in simplifying the process of applying a set of artificial nails, it is also relatively expensive due to its complex construction. The complex construction also compromises the reliability of the clipper. For example, the movable handle controls the sliding action of the blade through the link mechanism which couples the blade to the movable handle. Therefore, the reliability and performance of the clipper will be diminished if the notch and upper tongue of the link becomes worn or disengaged through extended or careless use. The same could happen if the spring becomes worn or loose through extended use. When the link becomes ineffective, the entire nail clipper must be replaced.

Thus, there is a need for a nail clipper that has a simple and durable construction, is reliable, safe and easy to use, and can be provided at low cost to the consumer.

SUMMARY OF THE INVENTION

The objects of the present invention may be achieved by providing a nail clipper having a clipper body. The clipper body has a front section and a rear section acting as a first handle. The front section has a top plate and a base plate defining a passageway therebetween. The top plate and the base plate each includes an aperture substantially aligned to each other and adapted to receive a finger nail therewithin. A blade is slidably positioned in the passageway, and has a cutting edge. The nail clipper further includes a second handle having a front end connected to the blade, and a flexible plate. The first end of the flexible plate is attached to the second handle and the opposing second end of the flexible plate is attached to the first handle. The flexible plate is adapted to normally bias the second handle and the blade in a retracted position rearward from the apertures. The second handle is adapted to be gripped against the first handle to overcome the bias of the flexible plate to advance the blade from the retracted position to a forward position in which the cutting edge of the blade passes the apertures to cut a finger nail positioned within the apertures. The normal bias of the flexible plate slides the blade and the second handle rearwardly when the grip of the second handle against the first handle is released.

Thus, the nail clipper according to the present invention has a simple construction. The blade is directly connected to the front end of the second handle so that the second handle directly controls the sliding operation of the blade. This improves the reliability and durability of the clipper since the direct connection between the blade and the second handle eliminates the need for an additional linking mechanism which would increase the opportunity for defect. In addition, the flexible plate is durable and effective for biasing the second handle in the rearward direction. Thus, the nail clipper has a simple construction, is reliable and durable, is safe and easy to use, and its simple construction allows it to be provided at low cost to the consumer.

BRIEF DESCRIPTION OF THE DRAWINGS

FIG. 4 is a cross-sectional side elevational view of the nail clipper of FIG. 1;

FIG. 5 is a cross-sectional side view of the front portion nail clipper of FIG. 1; and FIG. 6 is a front elevational view of the nail clipper of FIG. 1.

DESCRIPTION OF THE PREFERRED EMBODIMENTS

Figure 1:
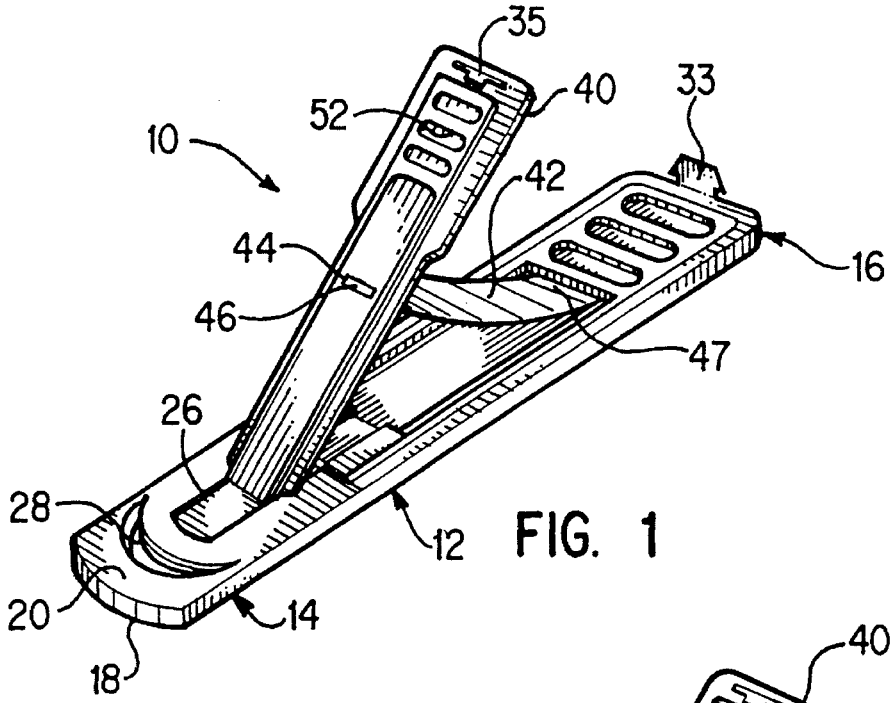
FIG. 1 is a perspective view of a nail clipper in accordance with an exemplary embodiment of the present invention.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The nail clipper 10 in accordance with a first preferred embodiment of the present invention is shown in FIGS. 1–6. The nail clipper 10 has an elongated clipper body 12 having a front section 14 and a rear section 16. The front section 14 comprises a base plate 18 and a top plate 20 connected by two sides 19 and 21 by riveting, soldering, welding, or any other conventional attachment mechanism. The base plate 18 and the top plate 20 have substantially the same width such that, when connected together by the sides 19 and 21, they define a substantially rectangular passageway 22 through which a blade 24 is slidably positioned. The front end 25 of the front section 14 is closed or sealed as a safety feature to prevent the blade 24 from sliding out of the passageway 22. The top plate 20 includes a substantially longitudinal slot 26 and a crescent-shaped aperture 28 forward of the longitudinal slot 26. The base plate 18 also has a crescent-shaped aperture 30 which is substantially aligned with the crescent-shaped aperture 28 of the top plate 20.

The rear section 16 of the clipper body defines a stationary handle. A plurality of corrugations 32 are provided adjacent the rear end 34 of the handle 16. In one embodiment, the base plate 18 of the front section 14 and the handle 16 of the rear section 16 comprise one integral plate which extends throughout the length of the clipper body 12. In another embodiment, the front and rear sections 14 and 16 may be provided separately and then attached by welding, soldering, or other conventional attachment mechanisms. The clipper body 12 preferably has an elongated configuration with a length of about 95 mm to 100 mm from the front end 25 to its rear end 34, and a width of about 18 mm to 20 mm. The height of the passageway 22, or the distance between the top plate 20 and the base plate 18, ranges from about 3 mm to 3.5 mm.

The nail clipper 10 further comprises a movable handle that is connected to the rear section or handle 16 of the clipper body 12 by a flexible spring plate 42. The movable handle 40 comprises a slot 44 through which a narrowed first end 46 of the flexible plate 42 is fitted and held. Although the slot 44 is illustrated as being provided about a central portion of the handle 40, it can also be provided anywhere along the handle 40 without departing from the spirit and scope of the present invention. Also, instead of fitting a narrowed end 46 into a slot 44, other mechanisms can be used to accomplish the connection between the first end of the flexible spring plate 42 and the second handle 40.

The opposing second end 47 of the flexible spring plate 42 is connected to a top surface of the rear section or handle 16. The flexible spring plate 42 may be provided as a separate piece and then connected to the handle 16 by soldering, welding, riveting or other conventional attachment methods, or may be provided integrally with the handle 16.

The front end 48 of the handle 40 is connected to, or provided integrally with, the back end of the blade 24. The blade 24 comprises a plate with a sharp cutting edge 50 at its front end. The longitudinal slot 26 in the top plate 20 is preferably wide enough to allow the front end 48 of the handle 40 to slide in reciprocal manner within the slot 26 as the blade 24 is reciprocated along the passageway 22. The front surface 49 of the slot 26 acts as a stop which prevents further advancement by the front end 48 of the handle 40.

The movable handle 40 has a plurality of corrugations 52 provided adjacent its rear end. The corrugations 32 and 52 provided on the handles 16 and 40 assist the user's fingers in firmly gripping the handles 16 and 40 when using the nail clipper 10. The movable handle 40 has a length ranging from about 80 mm to 83 mm, and is preferably about 82 mm. The width of the movable handle 40 is preferably consistent throughout its length, and ranges from about 12 mm to 17.5 mm. Although the front end 48 of the handle 40 is shown as having a width that is about the same as the width of the handle 40, it is possible to provide a narrowed front end 48 so that the longitudinal slot 26 may also be narrowed if desired. This can be accomplished by tapering the handle 40 near its front end 48 so that the width of the handle 40 progressively decreases towards the front end.

The length of the flexible spring plate 42 depends on the location of the slot 44 that receives the narrowed first end 46. The width of flexible spring plate 42 is also not critical, but must be of a sufficient width to provide the desired biasing action to keep the blade 24 in the retracted position, as described below.

A hook 33 is provided at the rear end 34 of the handle 16 and is adapted to engage a slot 35 provided at the rear end of the movable handle 40. This allows the two handles 16 and 40 to be held together to conserve space during packing an shipping.

Figure 2:
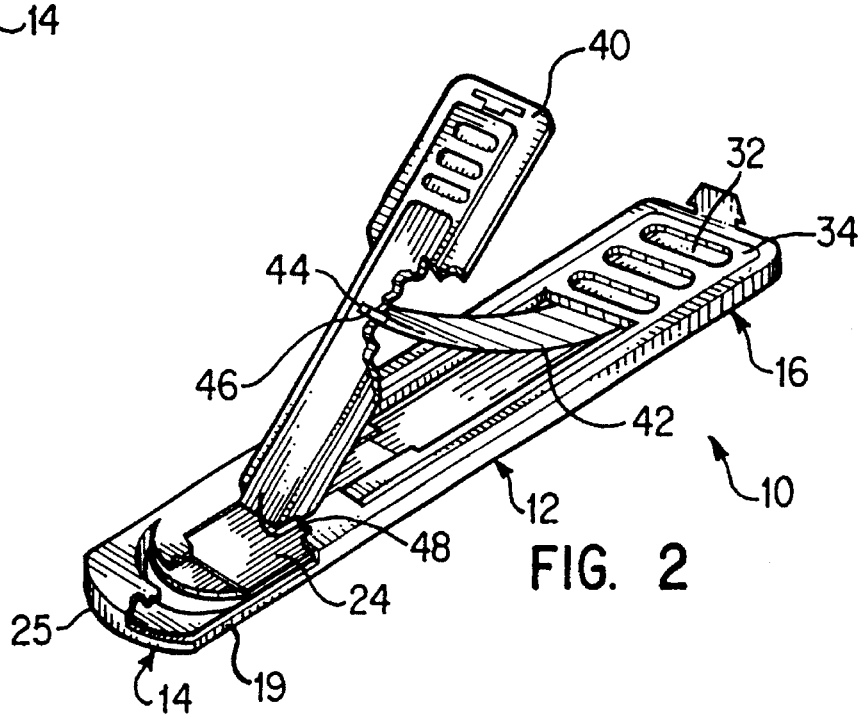
FIG. 2 is a cut-away view of the nail clipper of FIG. 1.
Figure 3:
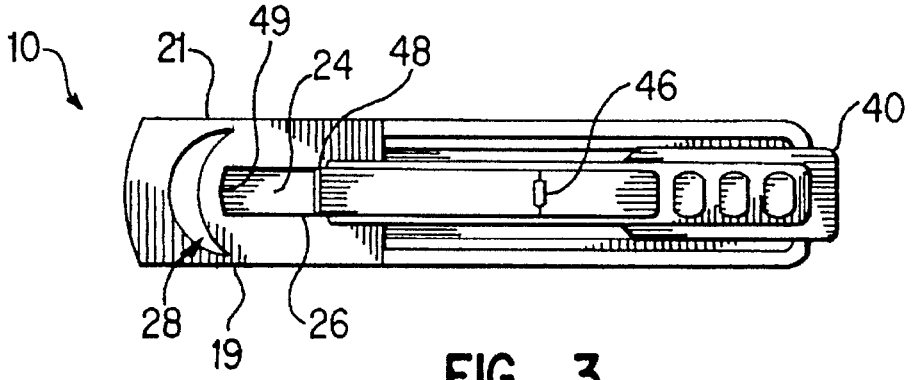
FIG. 3 is a top plan view of the nail clipper of FIG. 1.

The handle 40 is normally biased by the flexible spring plate 42 in a rearward direction to hold the blade 24 in the retracted position in passageway 22 rearward of the crescent-shaped apertures 28 and 30, as shown in FIGS. 1 and 2. When the blade 24 is in the retracted position, the apertures 28 and 30 are unobstructed and are adapted to receive a finger nail N (see FIG. 5). To cut a finger nail N, the user inserts the nail N through the crescent-shaped apertures 28 and 30, and then presses the movable handle 40 against the stationary handle 16. This overcomes the normal bias exerted by the flexible spring plate 42 on the handle 40, and forces the blade 24 to slide forwardly along the passageway 22 and across the apertures 28 and 30 to cut the finger nail N positioned within the apertures 28 and 30. After the nail N has been cut, the user releases the movable handle 40, so that the bias of the flexible spring plate 42 pulls the movable handle 40 rearwardly to retract the blade 24 back to the retracted position shown in FIGS. 1 and 2.

The clipper body 12, including its front section 14 and rear section 16, together with the blade 24, the movable handle 40 and the flexible spring plate 42, are preferably made from the same material, which may include a metal such as aluminum, stainless steel, high-carbon steel, or steel, or a non-metal such as plastic. Alternatively, each of these components may be made of a different material as desired.

The nail clipper 10 according to the present invention has a simple construction. The blade 24 is directly connected to the front end 48 of the movable handle 40 so that the movable handle 40 directly controls the operation of the blade 24. This improves the reliability and durability of the clipper 10 since the direct connection between the blade 22 and the movable handle 40 eliminates the need for an additional linking mechanism which would increase the opportunity for defect. In addition, the flexible spring plate 42 is durable and effective for biasing the movable handle 40 in the rearward direction. Thus, the nail clipper 10 has a simple construction, is reliable and durable, is safe and easy to use, and its simple construction allows it to be provided at low cost to the consumer.

While the description above refers to particular embodiments of the present invention, it will be understood that many modifications may be made without departing from the spirit thereof. For example, according to another embodiment, instead of a flexible spring plate 42, a coiled spring (not shown) may be provided without departing from the spirit and scope of the present invention. According to this embodiment, the spring would have one end connected to the movable handle 40 and a second end connected to the stationary handle 16, and would likewise operate to normally bias the movable handle 40 in the rearward direction.

What is claimed is:

1. A nail clipper, comprising:

a clipper body comprising a front section and a rear section, the front section comprising a top plate and a base plate defining a passageway therebetween, the top plate and the base plate each comprising an aperture substantially aligned with each other and adapted to receive a finger nail therewithin, the rear section comprising a first handle;

a blade slidably positioned in the passageway, the blade comprising a cutting edge;

a second handle having a front end connected to the blade; and a flexible plate having a first end and an opposing second end, the first end of the flexible plate attached to the second handle and the second end of the flexible plate attached to the first handle, the flexible plate adapted to normally bias the second handle and the blade in a retracted position rearward from the apertures;

wherein second handle is adapted to be gripped against the first handle to overcome the bias of the flexible plate to advance the blade from the retracted position to a forward position in which the cutting edge of the blade passes the apertures.

2. The nail clipper of claim 1, wherein the blade comprises a plate having a back end, with the front end of the second handle connected to the back end of the blade.

3. The nail clipper of claim 1, wherein the second handle comprises a central portion, and wherein the first end of the flexible plate is connected to the central portion of the second handle.

4. The nail clipper of claim 3, wherein the second handle comprises a slot, and wherein the first end of the flexible plate is fitted inside the slot of the second handle.

5. The nail clipper of claim 4, wherein the first end of the flexible plate is narrowed.

6. The nail clipper of claim 1, wherein the top plate comprises a longitudinal slot adapted to receive the front end of the second handle.

7. The nail clipper of claim 1 wherein the apertures are crescent-shaped.

8. The nail clipper of claim 1, wherein the normal bias of the flexible plate slides the blade and the second handle rearwardly when the grip of the second handle against the first handle is released.

9. The nail clipper of claim 1, wherein the first handle comprises a rear end and the second handle comprises a rear end, the rear end of the first handle comprising a hook, and the rear end of the second handle comprising a slot adapted for receiving the hook.

* * * * *